US011034173B2

(12) United States Patent
Fujiwara et al.

(10) Patent No.: US 11,034,173 B2
(45) Date of Patent: Jun. 15, 2021

(54) MEDIUM TRANSPORT DEVICE, RECORDING DEVICE, AND MEDIUM TRANSPORT METHOD

(71) Applicant: SEIKO EPSON CORPORATION, Tokyo (JP)

(72) Inventors: Daisuke Fujiwara, Matsumoto (JP); Takashi Akahane, Kamiina-Gun Miyada-Mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/800,728

(22) Filed: Feb. 25, 2020

(65) Prior Publication Data

US 2020/0276843 A1 Sep. 3, 2020

(30) Foreign Application Priority Data

Feb. 28, 2019 (JP) ..... JP2019-036377

(51) Int. Cl.

| | |
|---|---|
| ***B41J 15/16*** | (2006.01) |
| ***B65H 23/18*** | (2006.01) |
| *B65H 18/26* | (2006.01) |
| *B65H 23/188* | (2006.01) |
| *B65H 23/192* | (2006.01) |
| *B65H 23/26* | (2006.01) |

(52) U.S. Cl.

CPC ..... *B41J 15/16* (2013.01); *B41J 15/165* (2013.01); *B65H 23/18* (2013.01); *B65H 18/26* (2013.01); *B65H 23/188* (2013.01); *B65H 23/1813* (2013.01); *B65H 23/1888* (2013.01); *B65H 23/192* (2013.01); *B65H 23/26* (2013.01)

(58) Field of Classification Search

CPC ..... B41J 15/16; B41J 15/165; B65H 23/18; B65H 23/1888; B65H 23/188; B65H 23/192; B65H 23/26; B65H 23/1813; B65H 18/26

See application file for complete search history.

(56) References Cited

U.S. PATENT DOCUMENTS

2011/0242245 A1* 10/2011 Okazaki ..... B65H 23/16 347/104
2014/0203489 A1* 7/2014 Sasaki ..... B41J 15/16 270/1.01

(Continued)

FOREIGN PATENT DOCUMENTS

| | | |
|---|---|---|
| JP | 2011-011889 | 1/2011 |
| JP | 2018-012599 | 1/2018 |
| JP | 2018-177469 | 11/2018 |

*Primary Examiner* — Henok D Legesse
(74) *Attorney, Agent, or Firm* — Workman Nydegger

(57) ABSTRACT

A medium transport device includes a transport unit configured to transport a medium in a transport direction, a winding unit configured to wind the medium, a tension applying unit configured to apply a tension to the medium between the transport unit and the winding unit, a drive unit configured to drive the tension applying unit, and a controller configured to control the drive unit, in which the controller is configured to control the drive unit such that an application of the tension by the tension applying unit is released at a time when a subsequent transport operation by the transport unit is started after a termination of an winding operation of the medium by the winding unit.

9 Claims, 8 Drawing Sheets

(56) References Cited

U.S. PATENT DOCUMENTS

| | | | | |
|---|---|---|---|---|
| 2015/0054895 | A1* | 2/2015 | Suzuki | B41J 15/16 347/104 |
| 2016/0114997 | A1* | 4/2016 | Kawakami | B65H 23/188 226/181 |
| 2018/0215179 | A1* | 8/2018 | Akahane | B41J 13/0027 |

* cited by examiner

MEDIUM TRANSPORT DEVICE, RECORDING DEVICE, AND MEDIUM TRANSPORT METHOD

The present application is based on, and claims priority from JP Application Serial Number 2019-036377, filed Feb. 28, 2019, the disclosure of which is hereby incorporated by reference herein in its entirety.

BACKGROUND

1. Technical Field

The present disclosure relates to a medium transport device including a tension applying unit that applies a tension to a medium, a recording device provided with the medium transport device, and a medium transport method.

2. Related Art

JP 2011-11889 A discloses a transport mechanism configured to include a controller that once releases a tension applied to a medium at a predetermined frequency, and to then apply the tension again, at a predetermined frequency.

Many of medium transport devices are structured to provide a transport force to a medium while nipping the medium at a nip position in a transport unit. In a medium transport device provided with such a transport unit and the tension applying unit, when the transport of the medium is performed by the transport unit, a pulling force by the tension is applied, in case when a transport operation of the transport unit is started, to the transport force at the nip position depending on the magnitude of the tension applied by the tension applying unit. This may cause a slip transport by which the medium is transported with being slipped. The slip transport thus caused transports the medium by an amount more than an amount by which the medium is originally intended to be transported, to thus lower the transport accuracy. In recording devices such as an inkjet printer and the like, a banding occurs due to the slip transport, leading to an issue where the recording quality is lowered.

Unfortunately, the above JP 2011-11889 does not describe nor suggest the above-described issue of the slip transport.

SUMMARY

An aspect of the present disclosure for addressing the above-described issue includes a transport unit configured to perform transport operation to transport a medium, a winding unit configured to wind the medium transported by the transport unit, a tension applying unit configured to apply a tension to the medium between the transport unit and the winding unit, a drive unit configured to drive the tension applying unit, and a controller configured to control the drive unit. The controller is configured to, after a termination of an winding operation of the medium by the winding unit, control the drive unit such that an application of the tension by the tension applying unit is released at a time when a subsequent transport operation by the transport unit is started.

DESCRIPTION OF EXEMPLARY EMBODIMENTS

Figure 1:
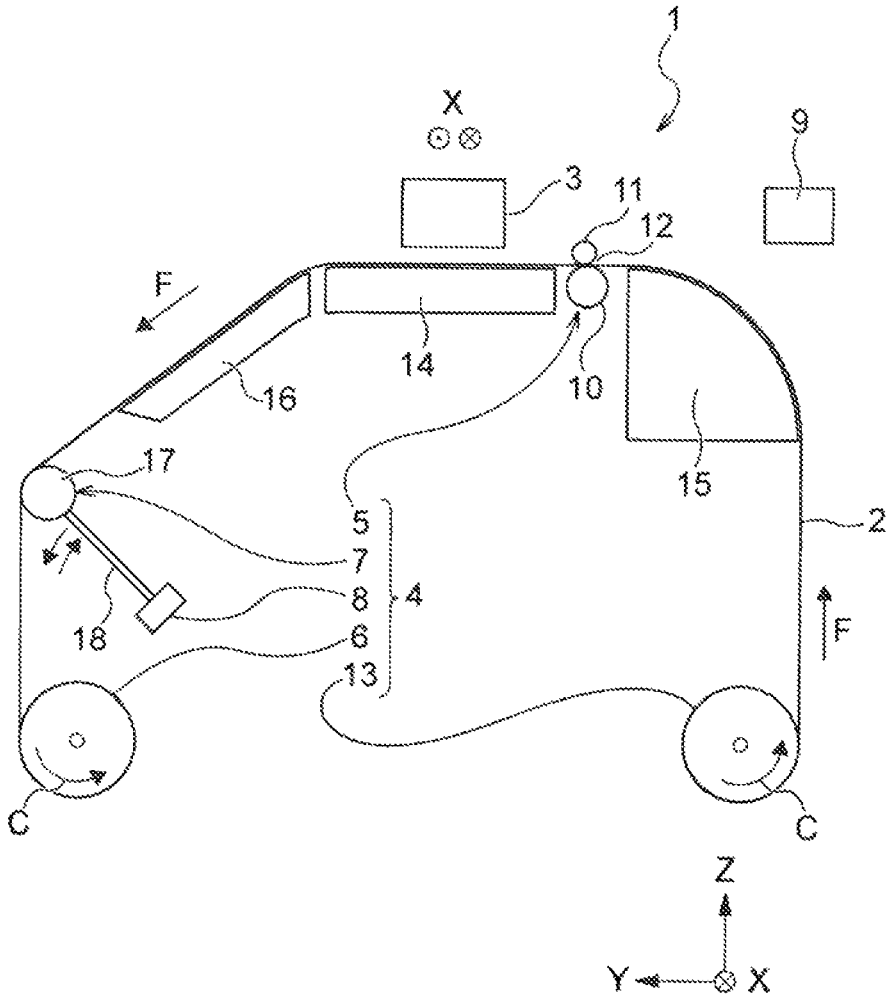
FIG. 1 is a side cross-sectional view schematically illustrating an outline of an overall configuration of a recording device according to Embodiment 1.

First, the present disclosure will be schematically described.

A medium transport device according to a first aspect of the present disclosure for addressing the above-described issue includes a transport unit configured to perform a transport operation to transport a medium, a winding unit configured to wind the medium transported by the transport unit, a tension applying unit configured to apply a tension to the medium between the transport unit and the winding unit, a drive unit configured to drive the tension applying unit, and a controller configured to control the drive unit, in which the controller is configured to, after a termination of a winding operation of the medium by the winding unit, control the drive unit such that an application of the tension by the tension applying unit is released at a time when a subsequent transport operation by the transport unit is started.

Here, the term "released" in the phrase "an application of the tension is released" is used in this specification in a sense that the term includes a state where a tension applied when winding a medium with the winding unit is reduced as long as the term satisfies the technical significance of the term released, without being limited to a state where the tension applied to the medium is zero (0).

According to the above aspect, the controller is configured to control the drive unit such that an application of the tension by the tension applying unit is released at a time when a subsequent transport operation by the transport unit is started after a termination of the winding operation of the medium by the winding unit. Thereby, the tension has already been released when the subsequent transport operation by the transport unit is started, thus making it possible to reduce the possibility of occurrence of the slip transport.

A medium transport device of a second aspect of the present disclosure is the medium transport device according to the first aspect, in which the tension applying unit includes a shaft member configured to abut the medium, and the controller is configured to control the drive unit such that a stop position of the shaft member, after a release of the tension, coincides with a predetermined target position.

According to the above aspect, the controller is configured to control the drive unit such that, after the release of the tension, a stop position of the shaft member coincides with a predetermined target position. This suppresses an application of excessive tension by the shaft member being abutted against a medium again until the start of the subsequent transport operation.

A medium transport device according to a third aspect of the present disclosure is the medium transport device according to the first aspect or the second aspect, in which the controller is configured to control the drive unit such that the tension is applied to the medium while the winding unit performs the winding operation of the medium.

According to the above aspect, the drive unit applies the tension to the medium while the winding unit performs the winding operation of the medium. That is, the medium can be wound with applying of a tension. This allows for an enhancement of the winding accuracy.

A medium transport device according to a fourth aspect of the present disclosure is the medium transport device according to any one of the first to third aspects, in which the controller is configured to start driving the winding unit based on an amount of the medium transported by the transport unit.

According to the above aspect, the driving of the winding unit is started based on an amount of the medium transported by the transport unit, stabilizing the start timing of the winding operation, and thus making it possible to perform a winding operation with high winding accuracy.

A medium transport device according to a fifth aspect of the present disclosure is the medium transport device according to any one of the first to fourth aspects, the medium transport device including a holding unit configured to hold the shaft member at a retracted position at which the shaft member is retracted, in which the controller is configured to control the drive unit such that the tension is applied such that the shaft member does not reach the holding unit.

According to the above aspect, the controller releases the tension such that the shaft member does not reach the holding unit. This suppresses the shaft member from being in a state held by the holding unit, thus suppressing the shaft member from being unable to return to a tension applying position at which the tension is applied. Thus, for example, when the medium transport device is in an unmanned operation, the shaft member can be reduced from becoming unable to return to the tension applying position without an awareness of an operator.

A medium transport device according to a sixth aspect of the present disclosure is the medium transport device according to any one of the first to fifth aspects, in which the controller is configured to control the drive unit such that a moving speed, at which the shaft member moves toward the medium to return to a tension applying position after a release of the tension, is within a predetermined range.

According to the above aspect, the controller is configured to control the drive unit such that, after the release of the tension, a moving speed toward the medium for the shaft member to return to the tension applying position falls within a predetermined range. This allows the shaft member to avoid being impulsively abutted against the medium when causing the shaft member to be moved from a tension released position at which the tension is released to the tension applying position and to come in contact with the medium again.

A recording device according to a seventh aspect of the present disclosure includes a recording unit configured to perform recording onto the medium, and the medium transport device according to any one of the first to sixth aspects.

According to the above aspect, when recording onto a medium is performed with the recording unit as a recording device such as an inkjet printer, an image can be formed in which white streaks and black streaks due to medium transport misalignment are suppressed.

A recording device according to an eighth aspect of the present disclosure is the recording device according to the seventh aspect, in which the controller is programmed to be performed following operations: the winding unit performs, in a state where the recording unit and the transport unit are stopped, the winding operation in a tension applying state where the tension by the tension applying unit is applied to the medium, the winding unit is stopped to terminate the winding operation, change the tension to a tension released state where the tension is not applied to the medium, the transport operation by the transport unit is started in the tension released state, and recording by the recording unit is performed, and when an amount of the medium transported reaches a predetermined amount, the tension released state is changed to the tension applying state, and the winding operation of the medium by the winding unit is performed in a state where the recording unit and the transport unit are stopped.

According to the above aspect, as the recording device, advantages of the above respective aspects can be achieved.

A medium transport method of a ninth aspect of the present disclosure is a medium transport method in a recording device, the recording device including a transport unit configured to transport a medium, a winding unit configured to wind the medium transported by the transport unit, a tension applying unit configured to apply a tension to the medium between the transport unit and the winding unit, and the medium transport method including performing, a transport operation of the medium, winding, the medium, and releasing, the tension at a time of performing a subsequent transport operation of the medium after winding the medium.

According to the above aspect, advantages as in the first aspect can be achieved.

Subsequently, configurations, functionalities, and advantages in Embodiments of the present disclosure are described below in detail with reference to the accompanying drawings.

Note that, in the description below, the outline of the overall configuration of the recording device according to Embodiment 1 will be described based on FIG. 1. Next, Embodiment 1 of the present disclosure will be described below with reference to FIGS. 2 to 4. Embodiment 2 of the present disclosure will be described below based on FIGS. 5 and 6. Embodiment 3 of the present disclosure will be described below with reference to FIGS. 7 and 8.

Note that in the figures, an X direction indicates a width direction of a medium 2, a Y direction in a support portion 14 indicates a transport direction F in which the medium 2 is transported, and a Z direction indicates a direction orthogonal to the X direction and the Y direction. Further, the transport direction F will be described as +F particularly when indicating a direction toward a winding unit 6, while the transport direction F will be described as −F particularly when indicating a direction toward a feeding-out unit 13 in the opposite direction to the direction toward the winding unit 6.

Embodiment 1

Outline of Overall Configuration of Recording Device (See FIG. 1)

As illustrated in FIG. 1, a recording device 1 according to Embodiment 1, which is a roll-to-roll type inkjet printer, includes a recording unit 3 on which a non-illustrated recording head configured to perform recording onto the medium 2 formed of a roll paper is mounted, and a medium transport device 4. In Embodiment 1, the recording unit 3 is of a serial type that performs recording by discharging ink from the above-described recording head while being reciprocatively moved in the width direction X of the medium 2.

The medium transport device 4 includes a transport unit 5 configured to perform a transport operation to transport the medium 2 in the transport direction F, the winding unit 6 configured to wind the medium 2 being transported in the transport direction F, a tension applying unit 7 configured to apply a tension to the medium 2 between the transport unit 5 and the winding unit 6, a drive unit 8 configured to drive the tension applying unit 7, and a controller 9 configured to control the drive unit 8. Further, the controller 9 controls the drive unit 8 such that an application of the tension by the tension applying unit 7 is released at a time when the subsequent transport operation by the transport unit 5 is started after a termination of the winding operation of the medium 2 by the winding unit 6.

The recording device 1 further includes the feeding-out unit 13 configured to feed out the medium 2 in the transport direction F, the support portion 14 located being opposed to the recording unit 3 and supporting the medium 2, a pre-heater 15 located upstream of the support portion 14 in the transport direction F, and an afterheater 16 located downstream of the support portion 14 in the transport direction F.

The pre-heater 15, the support portion 14, and the afterheater 16 form a part of the transport path of the medium 2.

Transport Unit

The transport unit 5 is located upstream of the recording unit 3 in the transport direction F of the medium 2, and is configured by a pair of a drive roller 10 and a driven roller 11. The transport unit 5 has a structure that provides a transport force to the medium 2 by rotation of both the rollers in a state of nipping the medium 2 at a nip position 12 of the pair of the drive roller 10 and the driven roller 11.

Winding Unit

In Embodiment 1, the winding unit 6 and the feeding-out unit 13 are each configured, under control of the controller 9, to be independently driven rotated by a non-illustrated drive unit. An arrow C indicates the rotation direction of the winding unit 6 and the feeding-out unit 13 when transporting the medium 2 in the transport direction F.

The winding unit 6 and the feeding-out unit 13 are rotatable in the opposite direction to that of the arrow C under control of the controller 9.

In Embodiment 1, the winding unit 6 is configured to perform, in a state where the recording unit 3 and the transport unit 5 are stopped, a winding operation in a state where the tension by the tension applying unit 7 is applied to the medium 2 under control of the controller 9.

In a state where the winding unit 6 stops the winding operation of the medium 2, a recording operation of the recording unit 3 and an operation of transporting the medium 2 by the transport unit 5 are repeatedly performed. This allows a slack part of the medium 2 to be formed and accumulated in front of the winding unit 6. Upon the slack part reaching a predetermined amount L, the winding unit 6 starts a winding operation. The start of the winding operation will be described below.

When the winding unit 6 starts the winding operation of the accumulated slack part of the medium 2, the recording unit 3 and the transport unit 5 are brought to an undriven state, that is, the recording unit 3 and the transport unit 5 are in a state where the recording unit 3 and the transport unit 5 are stopped. Then, upon the winding operation of the winding unit 6 proceeding to achieve the predetermined amount of winding of the slack part of the medium 2, the winding unit 6 is brought to an undriven state, that is, the winding unit 6 transitions to a state where the winding unit 6 stops driving in order to terminate the winding operation.

Tension Applying Unit

Figure 2:
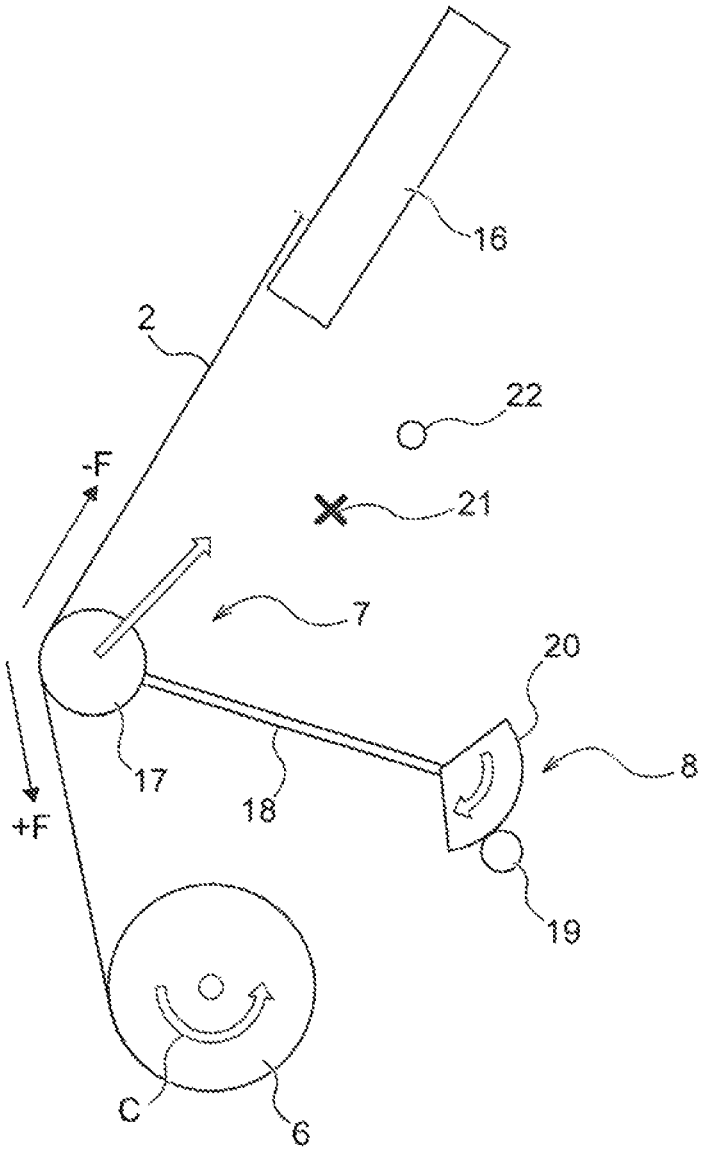
FIG. 2 is a side view schematically illustrating one state of a tension applying unit according to Embodiment 1.

As illustrated in an enlarged view in FIG. 2, the tension applying unit 7 includes a shaft member 17 that can abut the medium 2. The shaft member 17 having a cylindrical shape is rotatably coupled to the drive unit 8 via an arm 18.

The tension applying unit 7 is configured to be in a tension applying state where the shaft member 17 comes in contact with the medium 2, due to a drive of the drive unit 8, to apply a tension to the medium 2, and in a tension released state where the tension is not applied to the medium 2.

Here, the term "released" in the term "tension released state" is used in this specification in a sense that the term includes a state where a tension applied in winding the medium by the winding unit 6 is reduced as long as the term satisfies the technical significance of the released, without being limited to a state where the tension applied to the medium is zero (0). The phrase "technical significance of the released" represents that an influence of the slip transport is caused to be in a state of being prevented from occurring when the subsequent transport operation by the transport unit 5 is started after a termination of the winding operation of the medium 2 by the winding unit 6.

Further, the magnitude of the tension applied to the medium 2 during the winding operation is set such that issues such as occurrences of wrinkles and meandering of the medium 2 fall within an acceptable range when the winding unit 6 performs a winding operation. The magnitude may be constant or varied during the winding operation.

In Embodiment 1, the drive unit 8 of the tension applying unit 7 is constituted by a motor 19 and a gear wheel 20, where the gear wheel 20 is rotated with the rotation of the motor 19 as a power source. This allows the arm 18 to be swingably moved, thus causing the shaft member 17 to be pivotally moved and to then be able to be in each of the above-described tension applying state and tension released state.

The positions of the shaft member 17 and the arm 18 when the winding operation of the winding unit 6 is started are positions at which the shaft member 17 is rotated further downward than the positions in FIG. 2. From the downward position, the winding operation of the medium 2 is started, and as the winding operation proceeds, the length of the winding target part of the medium 2 is gradually shortened. Accompanying the above, the shaft member 17 and the arm 18 rotate in the direction of −F opposing to the transport direction F to be moved to the positions in FIG. 3.

Figure 3:
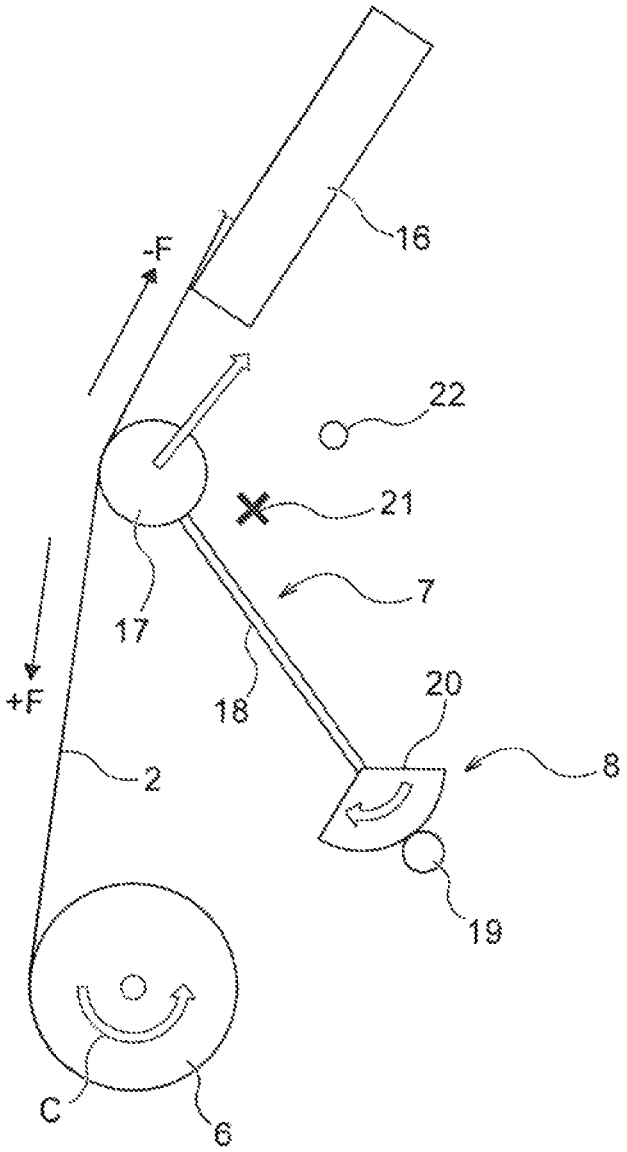
FIG. 3 is a side view schematically illustrating another state of a tension applying unit according to Embodiment 1.

FIG. 3 illustrates a state immediately before the shaft member 17 transitions from the tension applying state where the tension is applied to the medium 2 to the tension released state. In Embodiment 1, the shaft member 17 is configured, under control of the controller 9, to be rotated to a target position 21 being a stop position spaced apart from the medium 2 and to then be held at the target position 21. The holding of the shaft member 17 at the target position 21 is achieved by stopping the motor 19 of the drive unit 8 and by stopping and maintaining the rotation of the gear wheel 20 at the position. For example, the motor 19 is PID controlled such that the position of the shaft member 17 coincides with the target position 21.

It goes without saying that the present disclosure is not limited to the above, and any holding structure may be employed as long as the shaft member 17 may be stopped and held at the target position 21 and the tension released state may return to the tension applying state again.

Note that, while the shaft member 17 is moved from the position at which the winding operation of the medium 2 is started to the position illustrated in FIG. 3, a reaction force is exerted on the shaft member 17 via the medium 2 due to the exertion of the force of the winding unit 6 for winding the medium 2. When the shaft member 17 and the arm 18 can be rotated in the direction of −F by the reaction force, a non-illustrated transmission switching mechanism may be provided, in which the power of the motor 19 is ceased from being transmitted to the gear wheel 20 at the initial time when the winding operation is started, and the power of the motor 19 is transmitted to the gear wheel 20 at the time when the shaft member 17 is moved to the position illustrated in FIG. 3.

Control Unit

In Embodiment 1, the controller 9 is configured to start driving the winding unit 6 based on an amount of the medium transported by the transport unit 5.

The start timing of the winding operation of the medium 2 by the winding unit 6 is the time when the amount of transporting the medium reaches the predetermined amount L that is set in advance, where the amount of the medium transported by the transport unit 5 is sensed by a rotation amount of the drive roller 10. The predetermined amount L is a cumulative transport amount after the operation of transporting the medium 2 is performed for a plurality of times. At the time when the winding operation is started, as described above, the slack part of the medium 2 is in a state of being accumulated in the predetermined amount L in front of the winding unit 6. Upon the amount of transporting the medium reaching the predetermined amount L, the controller 9 controls the operation of each of the components such that the tension applying unit 7 in the tension released state is changed to be in the tension applying state and the winding unit 6 starts the winding operation of the medium, while the recording unit 3 and the transport unit 5 are stopped.

The winding operation of the winding unit 6 is terminated at the time when the amount of winding the medium 2 reached the predetermined amount L. The amount of the winding is sensed based on a rotation amount of the winding unit 6.

Here, the magnitude of the tension applied in the phrase "applies a tension" is set such that issues such as occurrences of wrinkles and meandering of the medium fall within an acceptable range when the winding unit performs a winding operation. The magnitude may be constant or varied during the winding operation.

The controller 9 controls the drive unit 8 such that an application of the tension by the tension applying unit 7 is released at a time when the subsequent transport operation by the transport unit 5 is started after a termination of the winding operation of the medium 2 by the winding unit 6.

Figure 4:
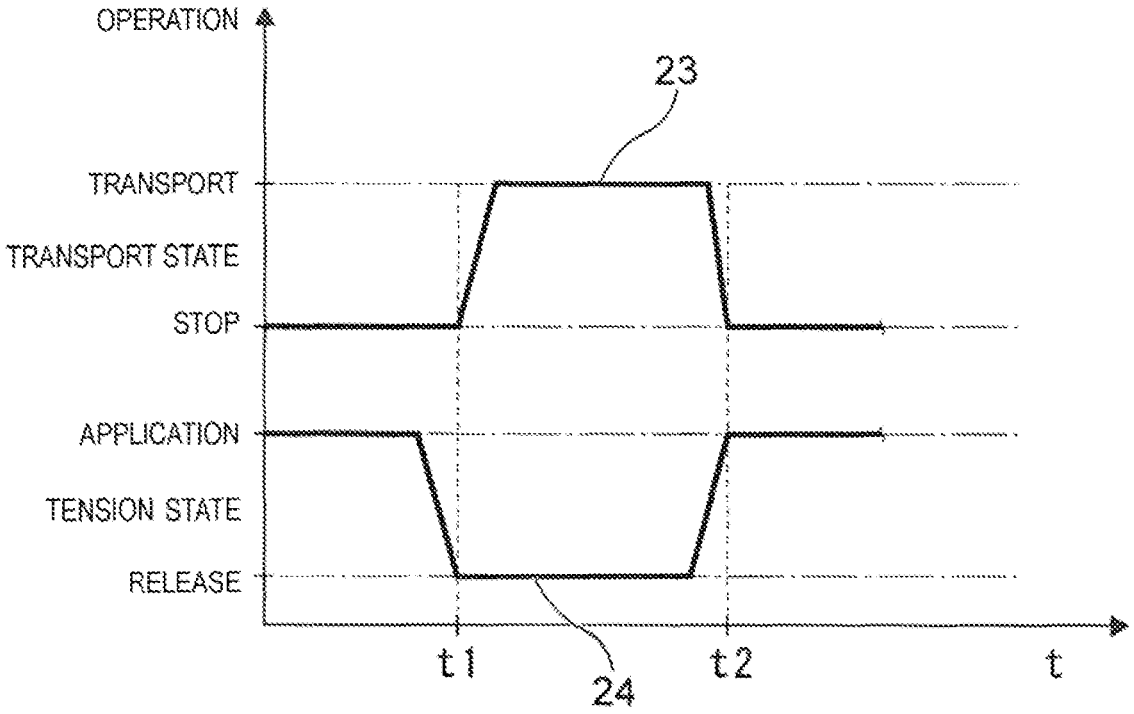
FIG. 4 is a time chart of a tension applying unit and a transport unit according to Embodiment 1.

FIG. 4 is an explanatory time chart, in the control, of a transport state of the transport unit 5 and the tensioning state of the tension applying unit 7. In FIG. 4, the reference sign 23 denotes the transport state curve that represents the transport state of the transport unit 5, and the reference sign 24 denotes a tensioning state curve that represents the tensioning state of the tension applying unit 7.

A timing t1 is the time at which the tension applying unit 7 is changed from in the tension applying state to in the tension released state after a termination of the winding operation of the winding unit 6. At this timing t1, the transport unit 5 is changed from in a stopped state to in a transport state, and the transporting of the medium 2 can be started in a state of being free from the influence from the tension. The transport unit 5 is passed through an acceleration region and a constant-speed region, and stops transporting when the amount of transporting the medium reaches the predetermined amount L. The timing t2 is the time at which the transport unit 5 has stopped and the tension applying unit 7 is changed to be in the tension applying state again. Thereafter, the winding operation of the medium 2 by the winding unit 6 is resumed.

In Embodiment 1, the controller 9 is configured to control the drive unit 8 such that, after the release of the tension, the moving speed toward the medium 2 for the shaft member 17 to return to the tension applying position falls within a predetermined range.

Here, "the moving speed falls within a predetermined range" represents that the shaft member 17 is moved within a speed range to avoid being impulsively abutted against the medium 2. This is because the abutment against the medium 2 at an impulsive moving speed may decrease the subsequent winding accuracy of the medium 2 and may cause a damage to the medium 2.

To specifically describe, if the tension applying unit 7 is not torqued by the drive unit 8 after the release of the tension, the shaft member 17 may fall in the gravitational direction to eventually come into contact with the medium 2 again. This is because there is a possibility that an impulse is exerted on the medium 2 when the shaft member 17 is abutted against the medium 2, to thus cause an excessive front tension to be applied depending on the speed at which the shaft member 17 is abutted against the medium 2. The predetermined range for the moving speed in the direction toward the medium 2 is predetermined based on experiments or simulations.

In Embodiment 1, as illustrated in FIGS. 2 and 3, the shaft member 17 is provided with a holding unit 22 configured to hold the shaft member 17 at a retracted position at which the shaft member 17 is retracted. Here, the term "retracted position at which the shaft member 17 is retracted" represents a position at which the shaft member 17 is held at a position spaced away from the tension applying position when not in use. In Embodiment 1, a structure is provided in which a part formed of a magnetic material (for example, iron or the like) is provided on the shaft member 17 and the arm 18, and the holding unit 22 is configured to include an electromagnet, to cause the shaft member 17 to be held at the retracted position by magnetic attraction. Setting the electromagnet of the holding unit 22 to OFF allows for an easy movement of the shaft member 17 from the retracted position to the tension applying position.

Then, the controller 9 is configured to control the drive unit 8 such that the tension is released within a range in which the shaft member 17 does not reach the holding unit 22. In other words, the controller 9 is configured to control the drive unit 8 such that the shaft member 17 does not reach the holding unit 22.09

Note that the holding unit 22 may be a permanent magnet in place of the electromagnet. In this case, the operator causes the shaft member 17 to be moved from the retracted position to the tension applying position. Alternatively, a hook may be provided as the holding unit 22, and a hole or the like that can hook the hook may be provided in the arm 18.

Explanatory Description of Advantages in Embodiment 1

According to Embodiment 1, the controller 9 controls the drive unit 8 such that an application of the tension by the tension applying unit 7 is released at a time when the subsequent transport operation by the transport unit 5 is started after a termination of the winding operation of the medium 2 by the winding unit 6. Thereby, the tension has already been released when the subsequent transport operation by the transport unit 5 is started, thus making it possible to reduce the possibility of an occurrence of the slip transport.

Further, the controller 9 controls the drive unit 8 such that, after the release of the tension, a stop position of the shaft member 17 coincides with a predetermined target position 21. This suppresses an application of excessive tension by the shaft member 17 being abutted against the medium 2 again until the start of the subsequent transport operation.

Further, the drive unit 8 apply the tension to the medium 2 while the winding unit 6 performs the winding operation of the medium 2. That is, the medium 2 can be wound with applying of a tension. This allows for an enhancement of the winding accuracy.

Further, the driving of the winding unit 6 is started based on the amount of the medium transported by the transport unit 5, stabilizing the start timing of the winding operation, to thus enable to perform a winding operation with high winding accuracy.

Further, the controller 9 releases the tension such that the shaft member 17 does not reach the holding unit 22. This suppresses the shaft member 17 from being in a state held by the holding unit 22, thus suppressing the shaft member 17 from being unable to return to the tension applying position. Thus, for example, when the medium transport device 1 is in an unmanned operation, the shaft member can be reduced from becoming unable to return to the tension applying position without an awareness of the operator.

To specifically describe, for example, in a case where the holding unit 22 is composed of a permanent magnet and the arm 18 is composed of a material including a magnetic metal such as iron, the arm 18, when coming in contact with the holding unit 22, is attracted to the holding unit 22, and thus the torque as is of the drive unit 8 may be insufficient to cause the shaft member 17 to return to the tension applying position. According to Embodiment 1, the controller 9 controls the drive unit 8 to release the tension within a range in which the arm 18 does not come in contact with the holding unit 22. This suppresses the arm 18 from being attracted to the holding unit 22 and to prevent the shaft member 17 from being unable to return to the tension applying position.

Further, the controller 9 is configured to control the drive unit 8 such that, after the release of the tension, the moving speed toward the medium 2 for the shaft member 17 to return to the tension applying position falls within a predetermined range. This makes it possible to allow the shaft member 17 to avoid being impulsively abutted against the medium 2 when causing the shaft member 17 to be moved from the tension released position to the tension applying position and to come in contact with the medium again. That is, the front tension applied to the medium 2 can be suppressed from becoming excessive.

Further, when recording onto the medium 2 is performed with the recording unit 3 as a recording device such as an inkjet printer, an image can be formed in which white streaks and black streaks due to medium transport misalignment are suppressed.

Medium Transport Method

The medium transport method in the recording device 1 is apparent from the above-described description, and includes the following steps.

The medium transport method in the recording device 1 includes the transport unit 5, the winding unit 6 configured to wind the medium 2, and the tension applying unit 7 including the shaft member 17 configured to abut the medium 2 to apply a tension to the medium 2 between the transport unit 5 and the winding unit 6, and the drive unit 8 configured to drive the tension applying unit 7, the medium transport method includes a first step for transporting the medium 2 with the transport unit 5, a second step for winding the medium 2 with the winding unit 6, and a third step for releasing the tension at a time when the first step is started after a termination of the second step. This makes it possible to achieve the above-described advantages described in Embodiment 1. In other words, the medium 2 transport method includes performing, the transport operation of the medium 2, winding, the medium 2, and releasing, the tension at a time of performing the subsequent transport operation of the medium 2 after winding the medium 2.

Embodiment 2

Figure 5:
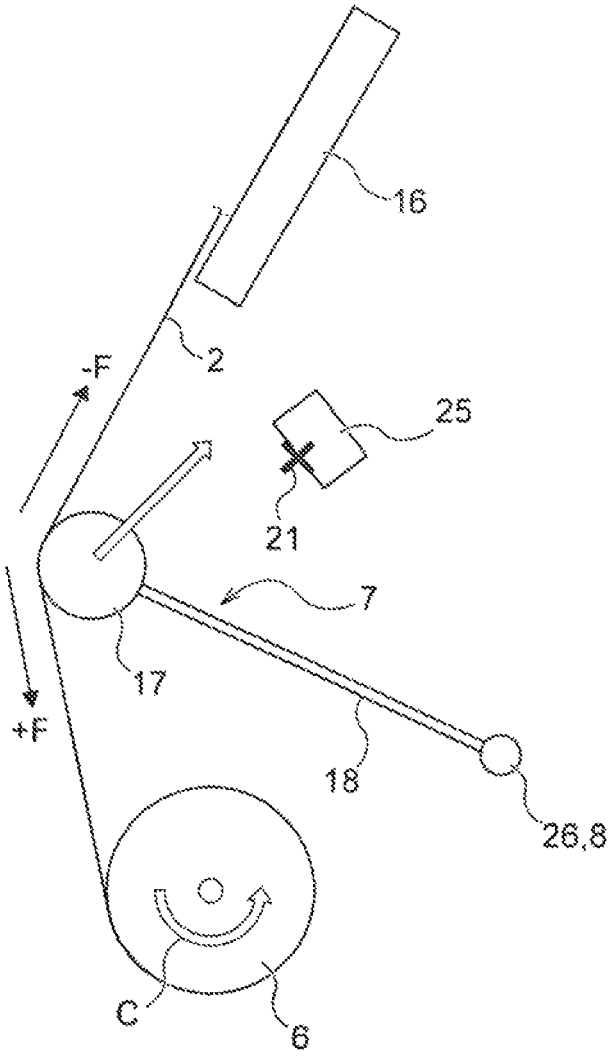
FIG. 5 is a view schematically illustrating one state of a tension applying unit according to Embodiment 2.
Figure 6:
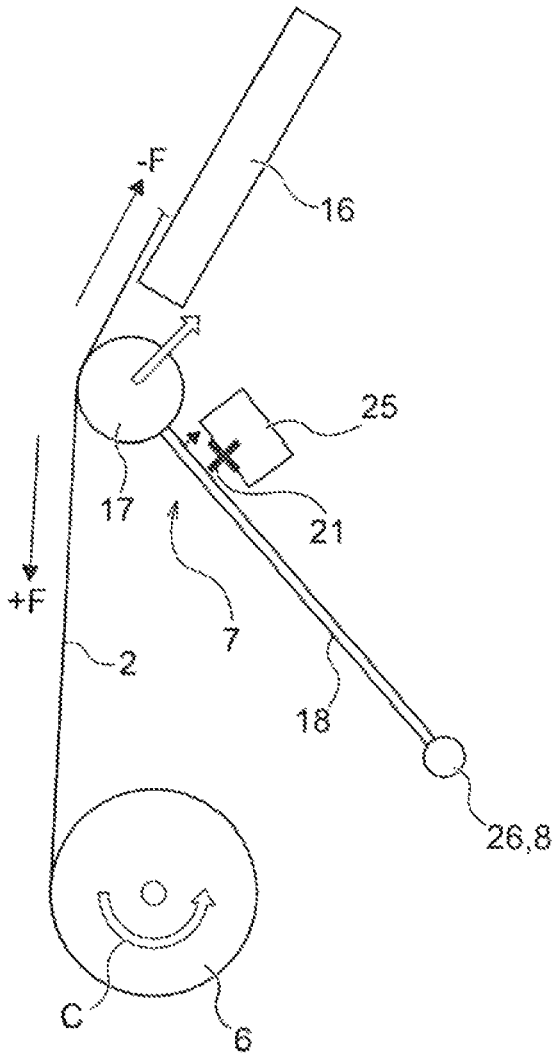
FIG. 6 is a view schematically illustrating another state of a tension applying unit according to Embodiment 2.

Embodiment 2 of the present disclosure are described below with reference to FIGS. 5 and 6.

In Embodiment 2, the arm 18 includes a magnetic material such as iron, where an electromagnet 25 is disposed at a position corresponding to the target position 21. The arm 18, from the position illustrated in FIG. 6 at which the winding operation of the medium 2 by the winding unit 6 is terminated, is further rotated with a portion of the magnetic material receiving a magnetic attraction force of the electromagnet 25, and maintained at the position with being attracted to the electromagnet 25. This state is the state where the tension is released. In FIGS. 5 and 6, the reference sign 26 denotes the pivoting fulcrum of the arm 18. The illustration of the drive unit 8 is omitted.

When the tension from the tension applying unit 7 transitions from the released state to the applying state, the electromagnet 25 is powered off to eliminate a magnetic attraction, allowing for the above-described transition. The drive unit 8 is controlled under control of the controller 9, to rotate the arm 18 such that the shaft member 17 is moved to the tension applying position.

According to Embodiment 2, the position of the shaft member 17 when the tension is released is stabilized, to thus achieve advantages as in Embodiment 1.

Embodiment 3

Embodiment 3 of the present disclosure are described below with reference to FIGS. 7 and 8.

Figure 7:
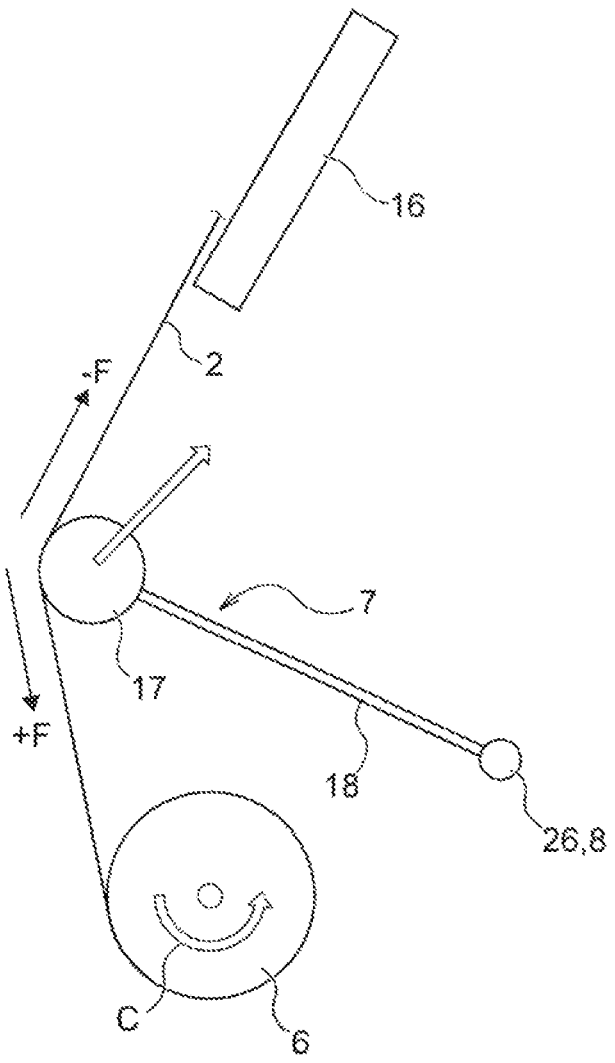
FIG. 7 is a view schematically illustrating one state of a tension applying unit according to Embodiment 1.
Figure 8:
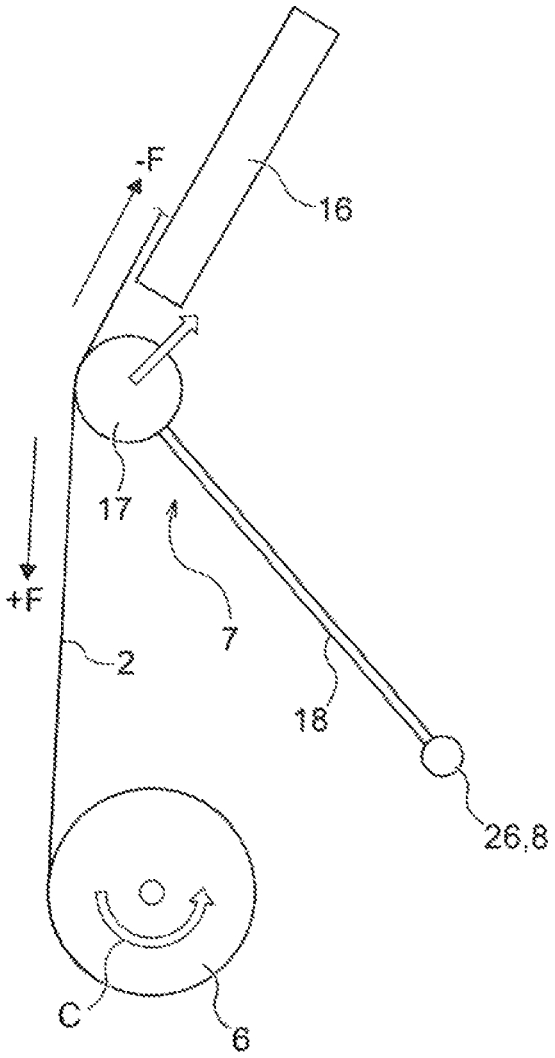
FIG. 8 is a view schematically illustrating another state of a tension applying unit according to Embodiment 1.

As already described, while the shaft member 17 is being moved from the position at which the winding operation of the medium 2 is started, that is, the position illustrated in FIG. 7 to the position illustrated in FIG. 8 corresponding to immediately before the application of the tension is released, the force with which the winding unit 6 winds the medium 2 is exerted on the medium 2. When the force is greater than a predetermined value, a force for pulling the medium 2 is also increased, thus, the reaction force being exerted on the shaft member 17 via the medium 2 is also increased.

Embodiment 3 corresponds to such a case. That is, the shaft member 17 is configured to be in a free state where the shaft member 17 is disconnected from the power from the drive unit 8 from the position at which the winding operation of the medium 2 by the winding unit 6 is started to the position illustrated in FIG. 8. When the winding operation of the medium 2 with the above-described increased force is performed in the above free state, the reaction force exerted on the shaft member 17 via the medium 2 is also increased, and at the time when the shaft member is moved to the position illustrated in FIG. 8, the shaft member 17 is in a state of being able to be moved to the released position by an inertial force of the shaft member 17.

In Embodiment 3, the inertial force is used to cause the shaft member 17 to be moved to the position of the tension released state, and to then be held at the position. The holding structure may be identical to that in Embodiment 2, or may be another structure.

According to Embodiment 3, the structure for releasing the tension can be simplified, to thus achieve advantages as in Embodiment 1.

The example of the recording apparatus 1 according to the present disclosure is based on having the configuration described above, however, it goes without saying that a change or an omission of a partial configuration can be done within a range that does not depart from the gist of the present disclosure of the present application.

What is claimed is:

1. A medium transport device comprising:

a transport unit configured to perform transport operation to transport a medium;

a winding unit configured to wind the medium transported by the transport unit;

a tension applying unit configured to apply a tension to the medium between the transport unit and the winding unit;

a drive unit configured to drive the tension applying unit; and a controller configured to control the drive unit, wherein the controller is configured to, after a termination of a winding operation of the medium by the winding unit, control the drive unit such that an application of the tension by the tension applying unit is released at a time when a subsequent transport operation by the transport unit is started.

2. The medium transport device according to claim 1, wherein the tension applying unit includes a shaft member configured to abut the medium, and the controller is configured to control the drive unit such that a stop position of the shaft member, after a release of the tension, coincides with a predetermined target position.

3. The medium transport device according to claim 1, wherein the controller is configured to control the drive unit such that the tension is applied to the medium while the winding unit performs the winding operation of the medium.

4. The medium transport device according to claim 1, wherein the controller is configured to start driving the winding unit based on an amount of the medium transported by the transport unit.

5. The medium transport device according to claim 1, comprising:

a holding unit configured to hold the shaft member at a retracted position at which the shaft member is retracted, wherein the controller is configured to control the drive unit such that the tension is released such that the shaft member does not reach the holding unit.

6. The medium transport device according to claim 1, wherein the controller is configured to control the drive unit such that a moving speed, at which the shaft member moves toward the medium to return to a tension applying position after a release of the tension, is within a predetermined range.

7. A recording device, comprising:

a recording unit configured to perform recording onto the medium; and the medium transport device according to claim 1.

8. The recording device according to claim 7, wherein the controller is programmed to be performed following operations:

the winding unit performs, in a state where the recording unit and the transport unit are stopped, the winding operation in a tension applying state where the tension by the tension applying unit is applied to the medium, the winding unit is stopped to terminate the winding operation, change the tension to a tension released state where the tension is not applied to the medium, the transport operation by the transport unit is started in the tension released state, and recording by the recording unit is performed, and when an amount of the medium transported reaches a predetermined amount, the tension released state is changed to the tension applying state, and the winding operation of the medium by the winding unit is performed in a state where the recording unit and the transport unit are stopped.

9. A medium transport method in a recording device, the recording device including:

a transport unit configured to transport a medium in a transport direction;

a winding unit configured to wind the medium; and a tension applying unit configured to apply a tension to the medium between the transport unit and the winding unit;

the medium transport method comprising:

performing transport operation of the medium;

winding the medium; and releasing the tension at a time of performing subsequent transport operation of the medium after winding the medium.

* * * * *